United States Patent [19]

Fujita

[11] 4,004,407

[45] Jan. 25, 1977

[54] DIGITAL DISPLAY ELECTRONIC TIMEPIECE

[75] Inventor: Kinji Fujita, Suwa, Japan

[73] Assignee: Kabushiki Kaisha Suwa Seikosha, Tokyo, Japan

[22] Filed: Sept. 19, 1974

[21] Appl. No.: 507,511

[30] Foreign Application Priority Data

Sept. 19, 1973 Japan ..... 48-105597

[52] U.S. Cl. ..... 58/23 R; 58/50 R; 58/85.5

[51] Int. Cl.[2] ..... G04C 3/00; G04B 19/30; G04B 27/00

[58] Field of Search ..... 58/23 R, 50 R, 85.5

[56] References Cited

UNITED STATES PATENTS

| | | | |
|---|---|---|---|
| 3,795,099 | 3/1974 | Tsuruishi | 58/23 R |
| 3,823,545 | 7/1974 | Vittoz et al. | 58/85.5 X |

*Primary Examiner*—E. S. Jackmon
*Attorney, Agent, or Firm*—Blum, Moscovitz, Friedman & Kaplan

[57] ABSTRACT

A digital display electronic timepiece having circuitry for adjusting the division ratio of the divider circuit and a digital display displaying the amount that division ratio is adjusted. The electronic timepiece includes a quartz crystal oscillator circuit for producing a high frequency time standard signal, a divider circuit including a plurality of series connected divider stages adapted to produce a low frequency time standard signal in response to said high frequency time standard signal, certain of said divider stages producing timekeeping signals representative of actual time in response to said low frequency time standard signal, and a division ratio adjustment circuit adapted to effect an adjustment of the low frequency signal in response to said high frequency signal. The adjustment circuit produces an adjustment setting signal indicative of the division ratio adjustment. Display elements are coupled to the certain divider stages, the display elements displaying actual time in response to the timekeeping signals.

9 Claims, 3 Drawing Figures

DIGITAL DISPLAY ELECTRONIC TIMEPIECE

BACKGROUND OF THE INVENTION

This invention is directed to a digital display solid state electronic timepiece and in particular to a digital display electronic timepiece wherein regulation of the division ratio of the divider circuit is provided and the amount of such regulation is indicated by the digital display elements.

Heretofore, prior art quartz crystal electronic timepieces, for the most part, have achieved regulation of the time standard frequency by adjusting the oscillator circuit and in particular the value of the trimmer capacitor therein. However, the range of such regulation was limited within a narrow value. Moreover, because the trimmer capacitor included movable elements, the reliability over long periods of time could not be satisfactorily maintained. Accordingly, as the popularity of quartz crystal electronic timepieces has increased, a time standard for an oscillator circuit which is inexpensive and provides the oscillator circuit with a wide range over which frequency can be adjusted has been sought.

Accordingly, regulation of the frequency of the time standard signal has been achieved sby varying the division ratio of the divider circuit. Although such division ratio adjustment admits of adjustment of the frequency over a wide range, the number of input terminals heretofore needed in conjunction with this method of frequency adjustment is considerable and hence renders difficult the miniaturization of an electronic timepiece to render same particularly suitable for use in a wristwatch. Moreover, a consequence of the difficulty of miniaturizing such a feature is the corresponding increase in the cost of manufacturing such timepieces. Accordingly a digital display electronic timepiece capable of having the division ratio of the divider circuit adjusted to effect frequency regulation and the amount of adjustment display is desired.

SUMMARY OF THE INVENTION

Generally speaking, in accordance with the invention, a digital display electronic timpiece capable of displaying the amount by which the division ratio of the divider circuit is adjusted is provided. The electronic timepiece includes an oscillator circuit for producing a high frequency time standard signal and a divider circuit including a plurality of series-connected divider stages to produce a low frequency time standard signal in response to the high frequency time standard signal applied thereto. A division ratio adjustments circuit is adapted to effect an adjustment of the low frequency time standard in response to said high frequency signal, the adjustment circuit including circuitry for producing an adjustment setting signal indicative of the division ratio adjustment. Certain of the divider stages produce timekeeping signals representative of the actual time. A selector circuit is operable in a first mode to select the timekeeping signals from the certain divider stages and is also operable in a second mode to select the adjustment setting signal. The display elements are coupled to the selector circuit, the display elements displaying actual time when selector circuit is in said first mode and the amount of division ratio adjustment when the selector circuit is in a second mode.

Accordingly, it is an object of this invention to provide an improved digital display electronic timepiece having a division ratio adjustment circuitry therein.

Still another object of this invention is to provide a digital display electronic timepiece capable of displaying the amount that the division ratio of the divider circuit is adjusted.

Still another object of this invention is to provide a miniaturized digital display electronic timepiece wherein the accuracy thereof is maintained, yet the cost of manufacturing same is minimized.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

For a fuller understanding of the invention, reference is had to the following description taken in connection with the accompanying drawings, in which.

DETAILED DESCRIPTION OF THE PREFERRED EMBODIMENTS

Figure 1:
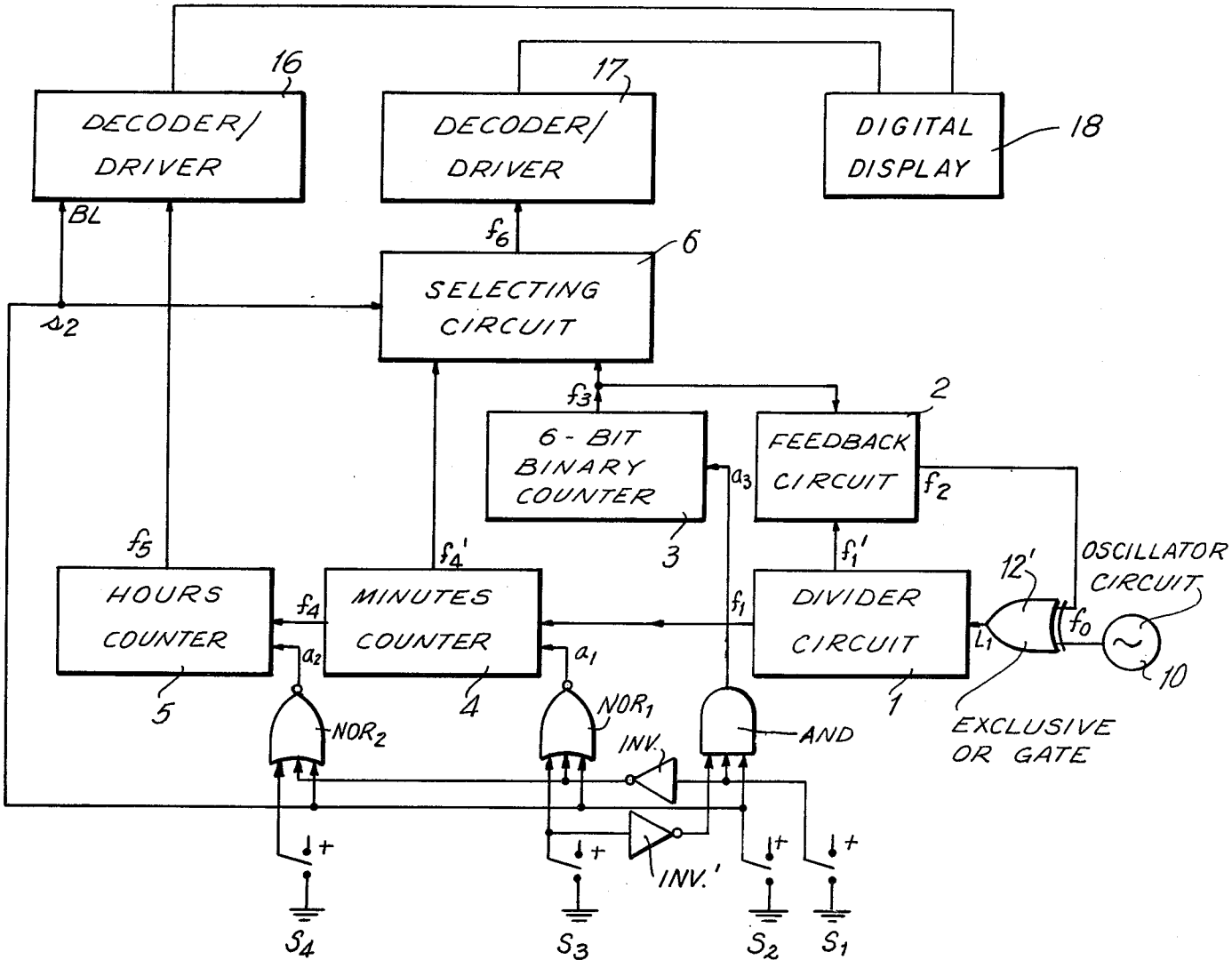
FIG. 1 is a block circuit diagram of a digital display electronic timepiece constructed in accordance with the instant invention.

Reference is now made to FIG. 1 wherein a block circuit diagram of a digital display electronic timepiece circuit in accordance with the instant invention is depicted. A quartz crystal oscillator circuit 10 produces a high frequency time standard signal $f_0$. As is hereinafter discussed, because adjustment in the high frequency time standard signal is achieved by adjusting the division ratio of the circuitry utilized to divide the high frequency time standard signal, an inexpensive and substantially untuned quartz crystal vibrator can be utilized, to thereby minimize the expense thereof.

An EXCLUSIVE OR gate 12 is adapted to receive as a first input the high frequency time standard signal $f_0$ and in the absence of a division ratio adjustment signal $f_2$, to be hereinafter discussed, applies the high frequency time standard signal $f_0$ as the input $L_1$ to a divider circuit 1. Divider circuit 1 includes a plurality of series connected divider stages adapted to produce a low frequency timekeeping signal $f_1$ having a period of 1 second. Two further divider stages are series connected to the output of divider circuit 1 to thereby provide a minutes counter 4 adapted to produce a timekeeping signal $f_4'$ representative of minutes counted, as well as an additional output $f_4$ having a period equal to 1 hour to the next divider stage which operates as an hours counter 5 and produces a timekeeping signal $f_5$ corresponding to the hours counted thereby. A minutes timekeeping signal $f_4'$ is applied to a decoder-driver circuit as an output $f_6$ of selecting circuit 6 when selecting circuit 6 is placed in a timekeeping mode, as is hereinafter discussed. The hours timekeeping signal $f_5$ is applied in the usual manner to a decoder-driver 16. Accordingly, signals applied to decoder-driver circuit 16 and 17 are applied to the digital display elements of a digital display 18 in a conventional manner to drive same. It is noted that selecting circuit 6 can be formed of any conventional logic switching circuit such as the switch 30, inverter 31 AND gates 32 and 33, and OR gate 34 depicted and described in U.S. Pat. No. 3,745,761, assigned to the assignee hereof.

The adjustment of the division ratio is effected by utilizing EXCLUSIVE OR gate 12 to advance the frequency of the high frequency time standard signal $f_0$ produced by oscillator circuit 10. Accordingly, an adjustment signal $f_2$ is produced by a feedback circuit 2 in response to the application of an adjustment setting signal $f_3$ and a low frequency timekeeping signal $f_1'$ from divider circuit 1. The amount of adjustment is determined by a 6-bit binary counter 3 and in response to the setting of the count thereof provides adjustment setting signal $f_3$ to feedback circuit 2 to thereby produce adjustment signal $f_2$ to the EXCLUSIVE OR gate 12 to adjust the advancement of the count of the high frequency time standard signal $f_0$ and apply same to the divider cirucit 1. The division ratio adjustment circuit disclosed in U.S. patent application No. 490,550, filed July 22, 1974, assignee to the assignee hereof, is an example of a division ratio circuit particularly suitable for use with the instant invention.

Figure 2:
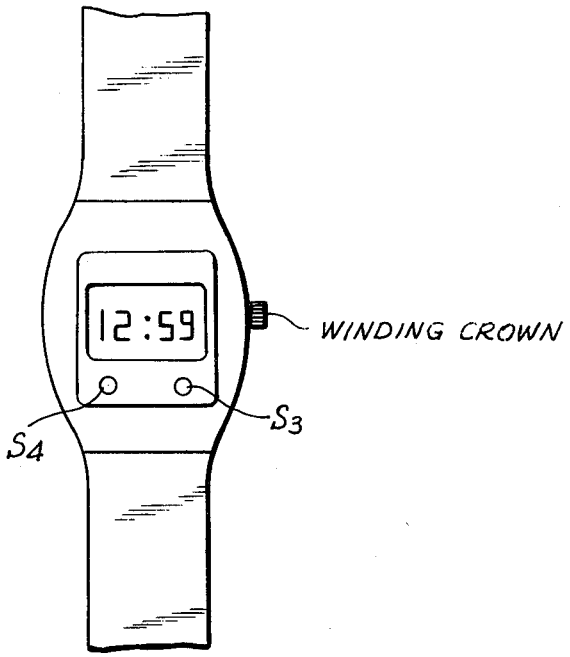
FIG. 2 is a perspective view of the digital display of the electronic timepiece illustrated in FIG. 1 when same is in a timekeeping mode.
Figure 3:
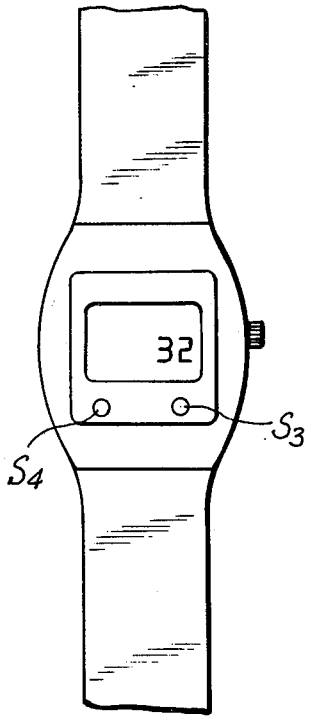
FIG. 3 is a perspective view of a digital display electronic timepiece illustrated in FIG. 1 when same is in a division ratio adjustment mode.

Selecting circuit 6 is adapted to receive the adjustment setting signal $f_3$ as a second input. As is hereinafter discussed, in response to the placement of selecting circuit 6 in a division ratio adjustment mode, the output $f_6$ of the selecting cirucit 6 is the division ratio adjustment setting signal $f_3$ and, accordingly, the digital display elements driven by decoder-driver circuit 17 indicate the amount of adjustment effected. The selecting circuit 6 remains in a timekeeping mode until same is actuated into a division ratio adjustment mode by application signal $s_2$ thereto. As is particularly illustrated in FIG. 2, in the absence of the application of a signal $s_2$ to the selecting circuit 6, the digital display displays the actual time counted by the timpiece. Upon the application of the mode selecting signal $s_2$ to selecting circuit 6 and to terminal BL of decoder-driver 16, as is particularly illustrated in FIG. 3, the hours digital display driven by decoder-driver 16 is blanked, and the decoder-driver circuit 17 applies the signal representative of the amount of division ratio adjustment produced by 6-bit binary counter 3 to the digital display to indicate the amount of division ratio adjustment effected thereby.

In order to effect the actuation of the selecting circuit 6 from a timekeeping mode to a division ratio adjustment mode, the switches utilized to effect correction of the divider stages producing timekeeping signals as well as a mode selection switch are provided. Additionally, a two position safety switch $S_1$ is provided for opening and closing the AND gate and NOR gates to thereby prevent any correction, or division ratio adjustment by inadvertently actuating the operating switches on the timepiece. Accordingly, when the switch $S_1$ is on the grounded side, a O is applied to an inverter circuit INV. disposed intermediate the safety switch and the respective gates $NOR_1$ and $NOR_2$. The 0 is inverted by the inverter circuit INV. and is applied as a 1 to gates $NOR_1$ and $NOR_2$. Accordingly, the outputs $a_1$ and $a_2$ of gates $NOR_1$ and $NOR_2$, respectively, remain at zero not withstanding the binary state of the other inputs to the NOR gates when a 1 is applied thereto by the safety switch $S_1$ by safety switch $S_1$ being disposed in a grounded position. Similarly, a zero is applied to the AND gate to thereby insure that any other signals applied to the AND gate produce a zero output $a_3$ while safety switch $S_1$ remains in a grounded position.

Upon displacement of safety switch $S_1$ to the positive position, the inverter circuit applies a zero to $NOR_1$ and $NOR_2$ to thereby allow same to produce a 1 if the other inputs thereto are at zero. The mode selection switch $S_2$ is a two position switch. When mode selection switch $S_2$ remains at ground, the selecting circuit 6 remains in a timekeeping mode. Thus, the timekeeping signals $f_4'$ and $f_5$, respectively produced by minutes counter 4 and hours counter 5, are applied to the decoder-driver circuit 16 and 17 to thereby effect a display of actual time. Moreover, since the mode selection signal $s_2$ produced by mode selection switch $S_2$ is applied to each of the gates $NOR_1$ and $NOR_2$, the positioning of the mode selection switch $S_2$ at zero coincident with the positioning of safety switch $S_1$ at 1 maintains the outputs of the NOR gates dependent upon the signal applied by correction switches $S_3$ and $S_4$. Accordingly, the respective actuation of switches $S_3$ and $S_4$ effect application of signals $a_1$ and $a_2$ to minutes counter 4 and hours counter 5 to effect correction of the time counted thereby. Thus when the safety switch $S_1$ is in a positive position and mode selection switch $S_2$ is in a grounded position, the digital display is operated in a normal timekeeping mode and operating switches $S_3$ and $S_4$ provide a normal timekeeping correction function to the minutes counter 4 and hours counter 5.

When adjustment of the division ratio is necessitated, the mode selection switch $S_2$ is positioned at a positive potential, the mode selection signal $s_2$ is applied to decoder driver 16 at terminal BL to thereby disable same and effect blanking of the digital display elements corresponding thereto. Mode selection signal $s_2$ is also applied to a selecting circuit 6 to thereby render the output $f_6$ thereof applied to decoderdriver 17 to correspond to the output $f_3$ of the 6-bit binary counter 3. Furthermore, since safety switch $S_1$ and mode selection switch $S_2$ are in a positive mode, the input terminals of the AND gate are maintained at a 1 and therefore renders the output $a_3$ of the AND gate responsive to the third input applied thereto through an inverter circuit INV.' thereto produced by correction switch $S_3$. Accordingly, when the correction switch $S_3$ is at a positive potential, each of the inputs to the AND gate are not positive or and 1 there is no output signal produced by the AND gate and correction switch $S_3$ is switched to a negative potential, all the inputs to the AND gate are positive and an output is produced thereby to effect adjustment of the counter 3. Accordingly, the division ratio adjustment setting signal $f_3$ produced by the 6-bit binary counter 3 is applied to the selecting circuit 6 and decoder-driver 17 to thereby allow same to be displayed by the digital display elements corresponding to decoder-driver 17.

Accordingly, as discussed above, adjustment of the division ratio is achieved by operating mode selection switch $S_2$ and by actuation of the correction-adjusting switch $S_3$. Moreover, by allowing the amount of adjustment of the division ratio to be displayed by the digital display, regulation of the division ratio can be achieved by an operator in a simple manner.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece comprising oscillator means for producing a high frequency time standard signal, divider circuit means including a plurality of series-connected divider stages adapted to produce a low frequency time standard signal in response to said high frequency signal, certain of said divider stages producing time keeping signals representative of actual time in response to said low frequency time standard signal, and division ratio adjustment means coupled to said divider circuit and adapted to effect an adjustment of the frequency of the low frequency signal in response to the high frequency signal, said division ratio means producing a setting signal corresponding to the amount of adjustment, digital display means for displaying one of actual time in response to said timekeeping signals being applied thereto and the amount of division ratio adjustment in response to the division ratio adjustment setting signal being applied thereto, and selector means operable between a timekeeping mode and an adjustment mode, said selector means being adapted to receive said timekeeping signals and apply same to said digital display means in said timekeeping mode and to receive said adjustment setting signal and apply same to said display means in said adjustment mode.

2. An electronic timepiece as claimed in claim 1, wherein said digital display means includes a plurality of display digits, said selector means being adapted to receive the timekeeping signals and apply same to each of said display digits in said timekeeping mode and to apply said adjustment setting signal to only certain of said same digital display digits in said division ratio adjustment mode.

3. An electronic timepiece as claimed in claim 2, wherein said division ratio adjustment means includes a counter adapted to be selectively energized to the division ratio adjustment amount desired, said counter producing said division ratio signal adjustment setting, and manually operated switching means coupled thereto to selectively set said counter.

4. An electronic timepiece as claimed in claim 3, wherein said division ratio adjustment means further includes feedback circuit means connected in series between said oscillator means and said divider means said feedback circuit means being adapted to receive said division ratio adjustment setting signal and a low frequency time standard signal and in response thereto produce a correction signal, and an EXCLUSIVE OR gate adapted to receive as a first input, said high frequency time standard signal and as a second input said correction signal, said EXCLUSIVE OR gate producing as an output in response to said input signals an adjusted high frequency time standard signal to said divider means.

5. An electronic timepiece as claimed in claim 1, wherein said selector means includes manually operated switch means adapted to selector one of said timekeeping and division ratio adjustment modes.

6. An electronic timepiece as claimed in claim 5, and including further switching means coupled to said certain divider stages and further coupled to said first manually operable switch means, said further switching means effecting correction of the count of said divider stages when said first manually operated switch means is in said timekeeping mode, said further switches effecting division ratio adjustment when said first switching means is in a division ratio adjustment mode.

7. An electronic timepiece as claimed in claim 6, wherein said certain divider stages produce timekeeping signals representative of the display of minutes and said display means are adapted to display the minutes timekeeping signal produced by said certain divider stages.

8. An electronic timepiece as claimed in claim 7, and including further divider stages for producing timekeeping signals representative of hours, and additional digital display means coupled to said selector means for receiving the timekeeping signals by said additional divider stages when said switching means is in a timekeeping mode, said additional display means being blank when said selection switching means is in a division ratio mode.

9. An electronic timepiece as claimed in claim 6, wherein said division ratio adjusting means includes a counter adapted to be selectively set to the division ratio amount desired, said counter producing said division ratio signal, said further swtiching means being coupled thereto to selectively set said counter when said first switching means is in said division ratio adjustment mode.

* * * * *